US011906260B2

(12) United States Patent
Ash

(10) Patent No.: US 11,906,260 B2
(45) Date of Patent: Feb. 20, 2024

(54) COMPRESSED GAS ROCKET DART FOR PERSONAL PROTECTION

(71) Applicant: Stephen R. Ash, Lafayette, IN (US)

(72) Inventor: Stephen R. Ash, Lafayette, IN (US)

( * ) Notice: Subject to any disclaimer, the term of this patent is extended or adjusted under 35 U.S.C. 154(b) by 0 days.

(21) Appl. No.: 18/062,035

(22) Filed: Dec. 6, 2022

(65) Prior Publication Data

US 2023/0184507 A1 Jun. 15, 2023

Related U.S. Application Data

(60) Provisional application No. 63/286,325, filed on Dec. 6, 2021.

(51) Int. Cl.

| | |
|---|---|
| ***F41B 11/62*** | (2013.01) |
| ***F41B 11/80*** | (2013.01) |
| ***F41F 3/045*** | (2006.01) |
| ***F41A 19/13*** | (2006.01) |

(52) U.S. Cl.

CPC ..... *F41B 11/62* (2013.01); *F41A 19/13* (2013.01); *F41B 11/80* (2013.01); *F41F 3/045* (2013.01)

(58) Field of Classification Search

CPC .... F42B 6/10; F42B 6/00; F41B 11/62; F41B 11/80; F41B 19/13; F41F 3/045

See application file for complete search history.

(56) References Cited

U.S. PATENT DOCUMENTS

| | | | | |
|---|---|---|---|---|
| 5,909,000 | A * | 6/1999 | Rakov | F41B 11/62 102/440 |
| 6,293,040 | B1 | 9/2001 | Luth | |
| 6,619,278 | B1 * | 9/2003 | Lin | F42B 5/10 102/440 |
| 7,434,344 | B2 | 10/2008 | Golan | |
| 9,989,335 | B2 | 6/2018 | Purvis | |
| 2011/0056471 | A1 * | 3/2011 | Kilvert | F41B 11/00 124/57 |
| 2018/0224228 | A1 | 8/2018 | Teach, Jr. et al. | |

* cited by examiner

*Primary Examiner* — J. Woodrow Eldred

(74) *Attorney, Agent, or Firm* — Gutwein Law; Tyler B. Droste

(57) ABSTRACT

The device of the present disclosure is a weapon. The weapon having a $CO_2$ powered projectile which is fired from the weapon, used principally for self-defense. The projectile is generally rocket shaped wherein the front end of the rocket can be formed by a rounded shape of a front of a $CO_2$ cylinder. The impact of the rocket projectile on a human could cause some pain, depending upon exactly what part of the body it hits. The impact could also cause some loss of balance to a human, due to the impact.

7 Claims, 10 Drawing Sheets

COMPRESSED GAS ROCKET DART FOR PERSONAL PROTECTION

CROSS-REFERENCE TO RELATED APPLICATION

This U.S. patent application claims priority to U.S. Provisional Application 63/286,325 filed Dec. 6, 2021, to the above-named inventor, the disclosure of which is considered part of the disclosure of this application and is hereby incorporated by reference in its entirety

FIELD OF THE INVENTION

This invention relates to a weapon, having a projectile capable of reaching a target, such as a human target, almost instantly and causing enough pain and physical damage to inactivate the human target, but not enough to cause the death of the human target.

BACKGROUND

Facing an armed assailant in a schoolroom is fortunately rare. However, for shop owners and policemen, it is a more common occurrence. The current options for self-defense weapons are actually very limited. Knives are worthless beyond arm's length unless the user is quite skilled at throwing them. Bows and arrows and crossbows are bulky and take considerable skill in use and must be loaded with arrows and darts at the time of use. Spring-loaded darts are hopelessly weak. Tazer devices are somewhat bulky and effective only at close range. The usual option considered is a gun.

The present disclosure provides a weapon capable of releasing a projectile immediately without loading or cocking. The weapon is configured to be easily aimed at a target, providing reasonably accuracy and effectiveness in a range of 20 feet or less, and low in recoil. The weapon is configured to provide a range and power of a limited capacity sufficient that the projectile can cause pain to a human target but the projectile can't penetrate walls or travel long distances, avoiding accidental damage to physical properties and accidental harm to a human target. In proper use, the weapon could save lives not only of those in danger by an assailant, but possibly the life of the assailant as well.

The projectile released by the weapon is visible while in flight to the human target, prompting the human target to duck or move to avoid the projectile.

The projectile released by the weapon travels with a speed sufficient to reach the human target before the human target moves. The weapon is capable of distracting the human target before reaching and hitting the human target, therefore the approaching projectile will divert the human target's attention, making the human target more susceptible to physical restraint, without causing the death of the human target.

A gun is defined as a "ranged weapon designed to use a shooting tube (gun barrel) to launch typically solid projectiles" (Wikipedia). More technically, a gun is a device which launches a projectile due to its own inertia. That means that the force of launching is created by a force that pushes the projectile in one direction and creates an equal and opposite force on the launching device with the barrel. In other words, every gun has "recoil" or force in the opposite direction from the travel of the projectile. If the gun is held by a person, the person supplies the force to counter the recoil. The recoil felt by the gun holder is just as strong as the force on the assailant. This effect is quite different from the effect of using a platform for launching self-propelled missiles, such as rockets. The force for accelerating a rocket is generated by the rocket itself, in reaction to the mass of exhaust being ejected from the rear of the rocket. Rockets create minimum "recoil" force on their launching platform, the only effect being of that which occurs from exhaust hitting the platform, or drag on the platform as the rocket leaves the platform.

Guns typically utilize explosives to generate the force to propel the projectile. Explosives provide the rapid expansion of gases to propel the projectile quickly out of the barrel. Explosives are intrinsically dangerous and require special handling. An alternative propellant in a gun is gas from a high-pressure source into the barrel to push the projectile (as in a pellet gun or paint-ball gun). The gas enters the barrel behind the projectile and pushes it to achieve high velocity. Recoil of the gun is still equal to the force propelling the projectile, just as if an explosive charge were used in bullet. With a gun, the accuracy is provided by high velocity of the projectile. Once the projectile leaves the barrel, it decelerates. With a rocket, speed increases as the rocket flies through air, until the source of the ejecting gases is depleted. A barrel for a rocket may help control its accuracy of flight, but in order for it to work, the barrel needs to be long enough for the rocket to gain speed and momentum before leaving the barrel. A fairly high velocity is needed for the tailfins to have resistance to motion through the air. This resistance to motion creates a drag force, which keeps the rocket in a straight course. That is why a bazooka has a fairly long barrel. If the posterior end of the barrel is obstructed, then the expulsion of a rocket may be more like a gun than a rocket. Speed may be increased within the barrel from this effect. However, the confluence of gases at the tip of the barrel may be somewhat chaotic and push the tailfins from side to side, resulting in diminished accuracy.

An ideal source of gas power for a small rocket is a carbon dioxide ($CO_2$) cartridge. These come in various sizes, from small cartridges containing 6 grams of $CO_2$ to cartridges with 80 grams or more $CO_2$. The $CO_2$ in these cartridges is highly pressurized at 800 PSI. At these high pressures, most of the $CO_2$ in the cartridge is in liquid form. The idea of a $CO_2$ powered rocket is not new, and hobbyists have created versions that are launched vertically from long tubes or rails. The puncture of the metal membrane on the back of the cartridge is often crated by a spike onto which the rocket is dropped or thrown. For a vertical launch, almost any size of puncture of the membrane will allow enough gas to propel the rocket upwards, and gravity doesn't affect the course of the rocket very strongly. The puncture does not need to be concentric on the membrane either. A long tube or rail can be used to increase the accuracy of vertical flights. The rocket always requires some kind of long tail with fins to keep a generally straight flight pattern.

However, as is described below, for a $CO_2$ rocket to be fired horizontally from a device, there are numerous requirements to be met to assure speed and accuracy of flight to the target. For example, the membrane puncture must be accurate and large, to allow maximum outflow gas velocity from the cartridge and create maximum velocity of the rocket as quickly as possible. The barrel will be necessarily short to allow for a hand-held device, and when the rocket leaves the barrel, it will be the drag on the fins and the rocket's momentum that stabilize its direction. The rocket must gain enough speed while in the barrel to produce forward momentum and create significant drag force of the fins. The fins must be fairly large to create a center of pressure near the rear end of the rocket, but the center of gravity must be as far forward as possible. The cartridge needs to be closely restrained in the barrel to offset the large sideways forces which can occur during the membrane puncture. The effect of gravity on the rocket will be to carry it downward during flight. The current invention provides a device that overcomes these disadvantages of the prior art. There is a need for a hand-held weapon that provides an impact sufficient to create some pain and localized trauma to a human target, but still not to cause lethal injuries.

BRIEF SUMMARY OF THE INVENTION

The device of the present disclosure is a generally referred to as a weapon. The weapon having a $CO_2$ powered projectile which is fired from the weapon, used principally for self-defense. The projectile is generally rocket shaped wherein the front end of the rocket is rounded shape and can be formed by a front of a $CO_2$ cylinder. The impact of the rocket projectile on a human could cause some pain, depending upon exactly what part of the body it hits. The impact could also cause some loss of balance to a human, due to the impact.

The weapon of the present disclosure provides an impact sufficient to create some pain and localized trauma to a human target, but still not to cause lethal injuries.

The weapon comprises a connector located at the front end of the device, wherein users may removably attach different types of projectiles. The connector may be a Luer-Lock fitting or other types of connectors enabling the user to removably attach needles or projectiles to the connector.

The rocket projectile may comprise a 1.5" 18-gauge needle to the front end of the rocket projectile. The needle capable of penetrating woven Kevlar®, metal mail or padded clothing at the time of impact. Regardless of where the rocket projectile hits the human or what structures it penetrated, the 18-gauge needle puncture would not create a hole so large that the body could not contain the loss of blood or other fluid from the puncture. A tip of the needle can optionally contain compounds to increase the pain of puncture such as capsaicin (from chili peppers), or a sedative type of drug. The weapon is envisioned and designed to be used with ease without training, such as at self-defense situations.

Needles of 18-gauge size are used in numerous medical procedures and have hit just about every organ within 1.5" of the skin surfaces. Bleeding caused by the puncture of an artery with an 18-gauge needle is easily stopped with application of pressure to the bleeding site. Without pressure, a hematoma may form with some sequelae, but certainly not enough to cause death.

The weapon may comprise a safety mechanism. The safety mechanism capable of reversibly changing the weapon from an armed position to an unarmed position, to prevent trigger movement and firing while in the unarmed position and to allow trigger movement and firing when in the armed position.

The weapon may comprise several loading locations to allow for a single weapon to have multiple rockets loaded. The weapon configured to launch the multiple rocket projectiles simultaneously or in quick succession.

The weapon of the present disclosure meets the requirements for a safe and effective self-defense weapon. Such as time to target at 10 feet less than 0.1 seconds, at 20 feet less than 0.2 seconds. Accuracy within 6" of bullseye at 10 feet, and within 12" at 20 feet. Range when fired horizontally from shoulder level, 100 feet or less. Minimum Recoil (something less than a pellet gun). Light weight (less than 2 pounds when loaded). Length less than 2 feet including barrel or other mechanism for guiding the rocket in launch. Twin handles which can be held onto a desk surface to impart greater stability. Can be aimed and fired using one or two hands. Overall size which can fit in desk or counter drawer, with rocket loaded. Easily "armed" with a mechanism providing potential energy for the cartridge puncture (using hand effort or a separate component to provide this energy). Easily re-loaded with subsequent rocket projectiles after each launching. Can be safely stored while in armed condition, ready to use. Minimal training required for use, even for individuals who have never fired a gun.

DETAILED DESCRIPTION OF THE INVENTION

Figure 1A:
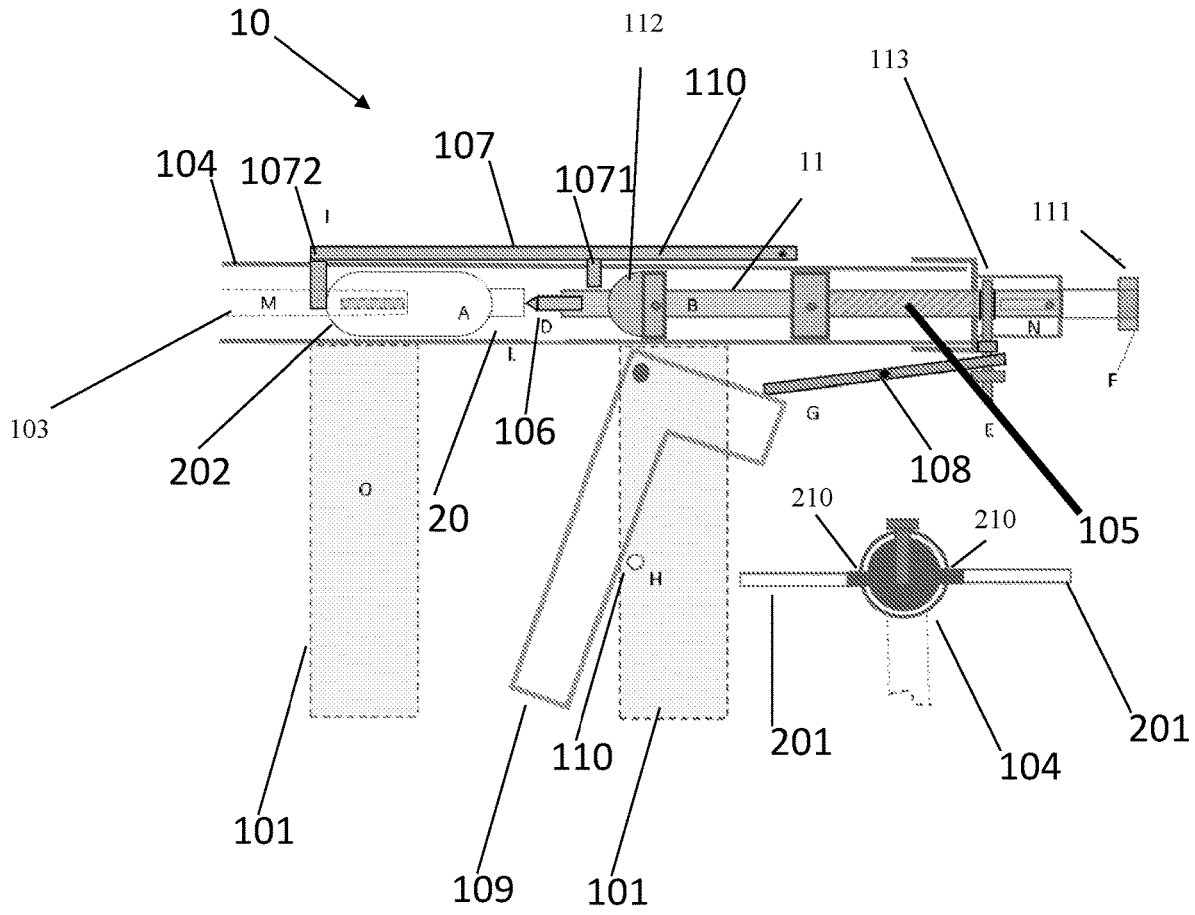
FIG. 1A is an axial cross section of the device in the loaded and armed position with a horizontal cross section, showing the cartridge, fins and spacers.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 1B:
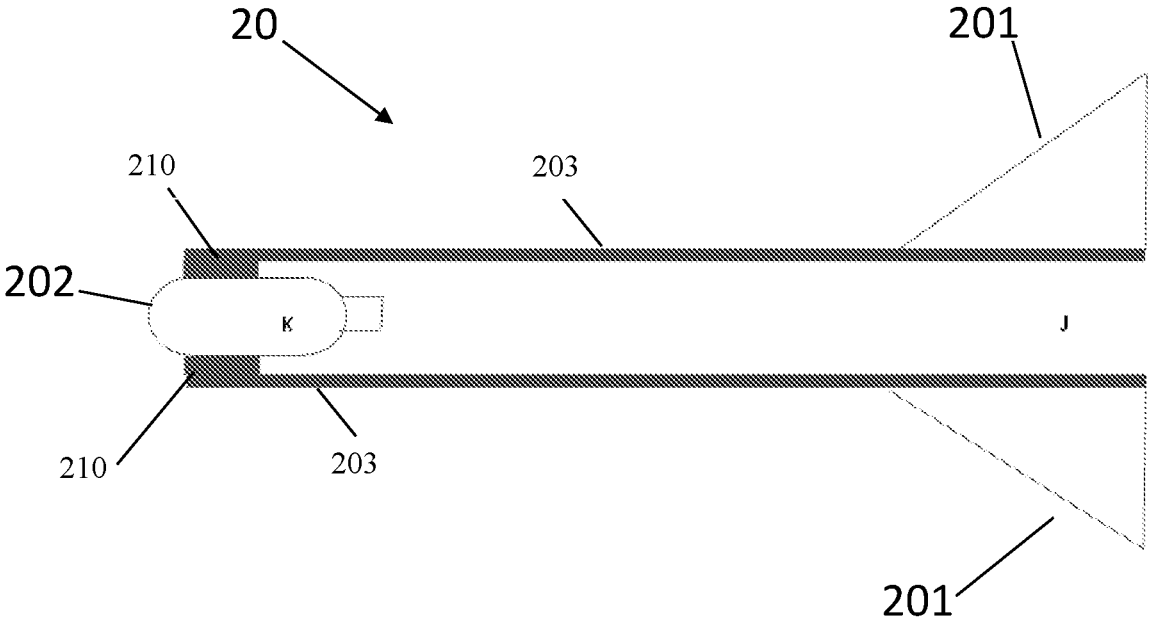
FIG. 1B is a side view of the rocket projectile.

Referring now to the Figures, FIG. 1A shows an axial cross section of the exemplary device, generally referred to as a weapon 10 having a barrel 104, at least two channels 103, two handles or front and rear twin handles 101. The weapon 10 is shown with a projectile 20 loaded and in an armed position. The projectile 20 is generally rocket shaped wherein a front end of the rocket is rounded shape and can be formed by a front of a gas cylinder 202. In the preferred embodiment the gas cylinder is a $CO_2$ cylinder 202. FIG. 1B shows a side view of the rocket projectile 20 having at least two fins or tailfins or spars 201 located outside a posterior end of the rocket projectile 20. The tail spars 203 are separated from the gas cylinder by spacers 210, which protrude through the channels 103 to support tail spars 203 and fins 201 so they sit outside the barrel 104 while the gas cylinder is inside the barrel.

The active mechanisms of the device 10 are mostly contained both inside and outside of the barrel 104, which is generally made of aluminum or reinforced carbon fiber. The device 10 may have a plurality of channels 103. The figures are perspective and show only two channels 103 for easier demonstration of the active mechanisms.

In one embodiment of the present disclosure a $CO_2$ cartridge with a 12-gram capacity (weight 40 gm, full), with over 80% of rocket weight comprised by the full $CO_2$ cartridge rendered a rocket projectile weighting 51 grams.

In one embodiment the device 10 comprises a spring-powered mechanism via a spring 105 with a sharp point 106 to puncture the membrane of the $CO_2$ cartridge 202. Preferably spring 105 is a 53 lb/inch spring, coiled around the central shaft 11 of the puncture mechanism. Preferably the sharpened point 106 is a 0.080" diameter steel spike, tapered at the tip. The device may further comprise a winding mechanism consisting of a nut 111 rotating on a threaded portion of the shaft 11 of the device 10, which when rotated clockwise withdraws the shaft 11 from the barrel 104. This screw motion provides a mechanical advantage in compressing the spring 105.

Further, a release rod 107 is mounted on top of the barrel 104 with a hinge. A vertical bar 1072 attached to the release rod 107 rests in front of the gas cartridge 202 and prevents the cartridge from moving forward. A steel pin 1071 is coupled to a middle portion of the release rod 107 and extends through a hole 10711 into the barrel to lie in contact with the shaft 11, the hole 10711 located underneath a cover 120. The cover 120 located at the end of the release bar 107, to keep the release bar from moving out further than needed during the release the $CO_2$ cartridge. The cover 120 covers the end of the release bar 107 which is attached to the release pin 1072. This pin 1071 will be lifted by a rounded attachment 112 to the puncture mechanism shaft 11 as the shaft 11 moves forward, lifting the pin 1071 in a cam action. As a result the release rod 107 is lifted, moving the vertical bar outward and freeing the gas cartridge 202 to move forward. When the puncture mechanism is stationary, the vertical rod 107 keeps the gas cartridge 202 in place and the device 10 in a loaded and armed position securely.

The puncture mechanism is held in position when armed by a retaining pin 113 which traverses the shaft 11 through a hole.

Release of the shaft 11 and sharpened portion 106 is enabled by a user via the trigger 109 and a trigger lever 108 which removes the retaining pin 113 from the shaft 11, to allow motion of the shaft 11 and sharpened portion 106 to puncture the $CO_2$ cartridge 202. The vertical bar 1072 coupled to a front end of the release rod 107 holds the rocket projectile 20 in position during membrane puncture. As puncture is completed, the rounded attachment 112 to the shaft 11 lifts the steel pin 1071, lifting the release rod 107 and the vertical bar 1072 moves upwards, thus enabling the rocket projectile to be released as the puncture is completed.

The barrel 104 is configured to tightly hold the $CO_2$ cartridge 202 during puncture and assures a straight path for the rocket projectile 20 during launch.

In one embodiment of the present disclosure a safety mechanism 110 can be installed to secure the trigger 109 to avoid accidental firing when the device 10 is armed. In yet another embodiment the device 10 may optionally comprise a laser used for aiming.

The device of the present disclosure is construed as to render the center of pressure located at the far rear of the rocket projectile and the center of gravity located far forward with the light weight tailfins and far forward $CO_2$ cartridge.

The at least two slots 103 in the barrel 104 allow the cartridge to connect to spars of the tailfins 201 which are located outside the posterior end of the barrel 104 after loading the rocket projectile 20 within device 10 and during the launching mechanism. The at least two slots 102 also allow the exhaust from the cartridge 202 to exit from the barrel as the cartridge 202 advances to the front end of the barrel 104 after puncture, which avoids having the gases leave through the front end of the barrel 104 just when the rocket 20 is establishing flight.

The closed posterior end of the barrel 104 collects the first gas discharge from the cartridge 20 after puncture and creates a force to move the cartridge 20 forwards to the front end of the barrel 104 and off the sharpened portion 106.

Figure 2:
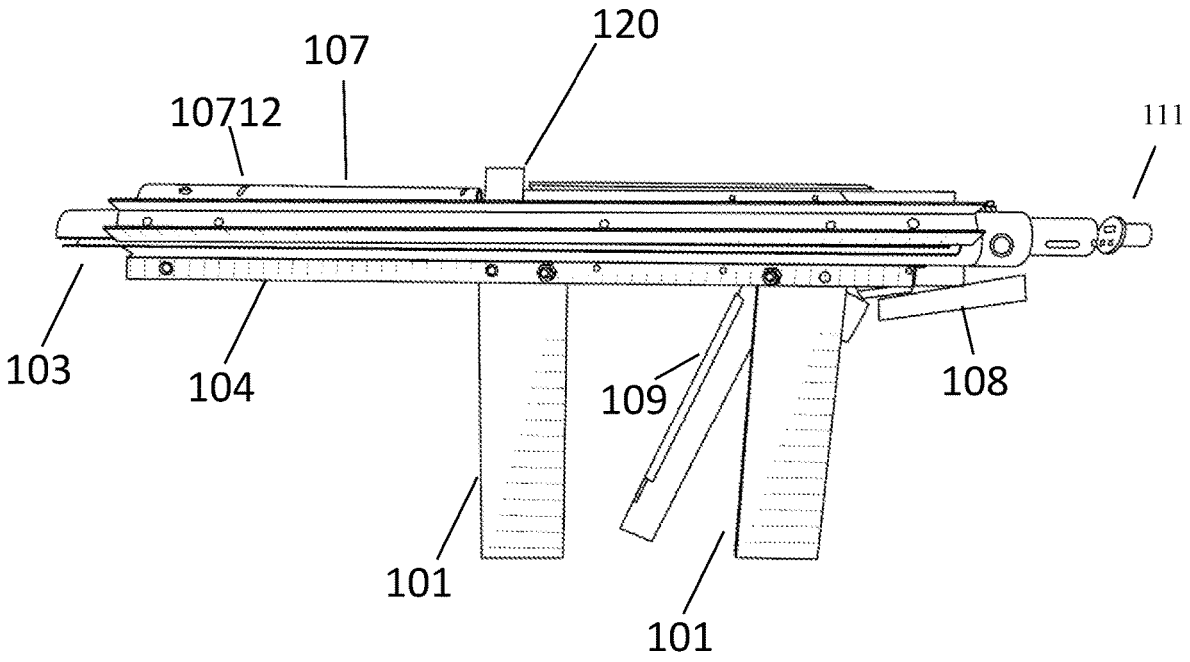
FIG. 2 is a side view of the device loaded with a rocket projectile.

FIG. 2 is a side view drawing from a photograph of the device 10 construed as an exemplary embodiment of the present disclosure, having the rocket projectile loaded. This device has 3 slots for connection to the tailfin spars and 3 reinforcing C-channels glued onto the barrel to assure linearity of the barrel. The device has been armed by winding the nut 111 on the shaft 11 of the puncture member. The retaining pin 113 has automatically advanced through the hole in the shaft 11, to secure the shaft 11 into position. The shaft 11 is ¼" diameter brass. The nut 111 has then been withdrawn to the resting position near the rear end of the shaft 11. A safety pin 110 has been placed through the rear twin handle 101 so that the trigger 109 cannot accidentally be pulled.

Figure 3:
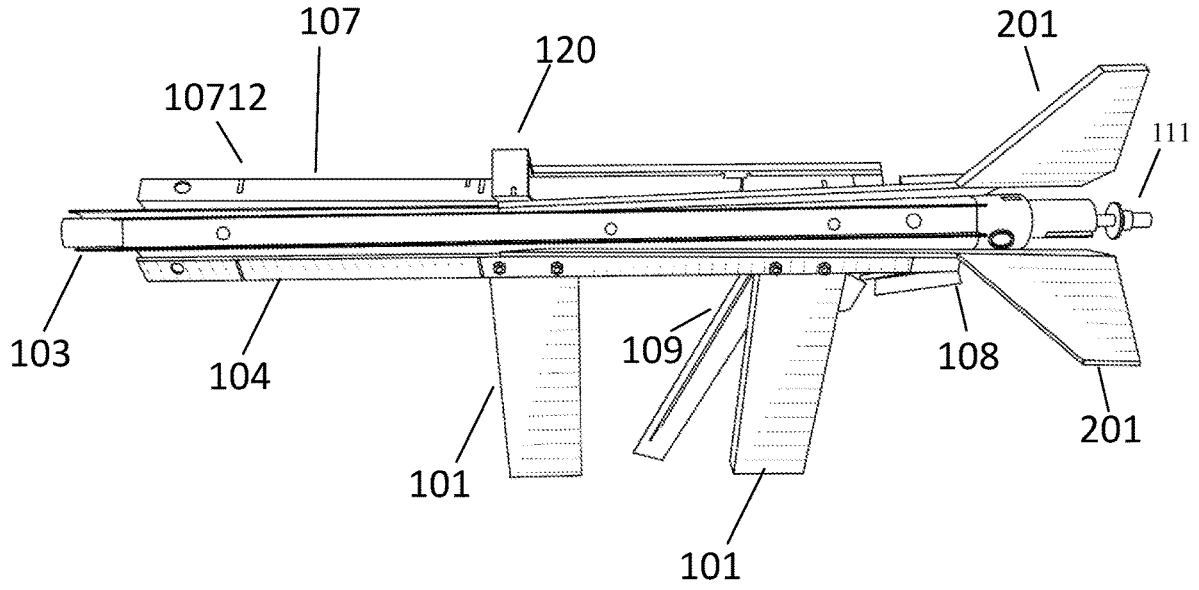
FIG. 3 is a view of the device loaded with a rocket projectile with the safety pin removed.

FIG. 3 is a top view drawing from a photograph of the device 10 construed as an exemplary embodiment of the present disclosure, having the rocket projectile loaded, still in the armed and loaded position, with the safety pin installed. The barrel is made from carbon fiber tubing with another strip of carbon fiber glued with epoxy to the outside of the barrel for support, between the three slots. Three aluminum C-channels are attached with epoxy to the outside of the strips of carbon tubing.

Figure 4A:
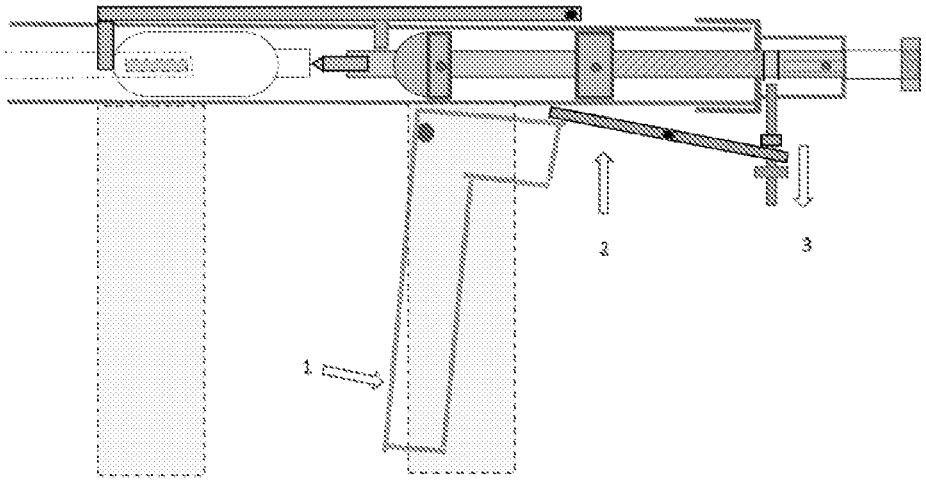
FIG. 4A is a mechanistic view of action of the device.
Figure 4B:
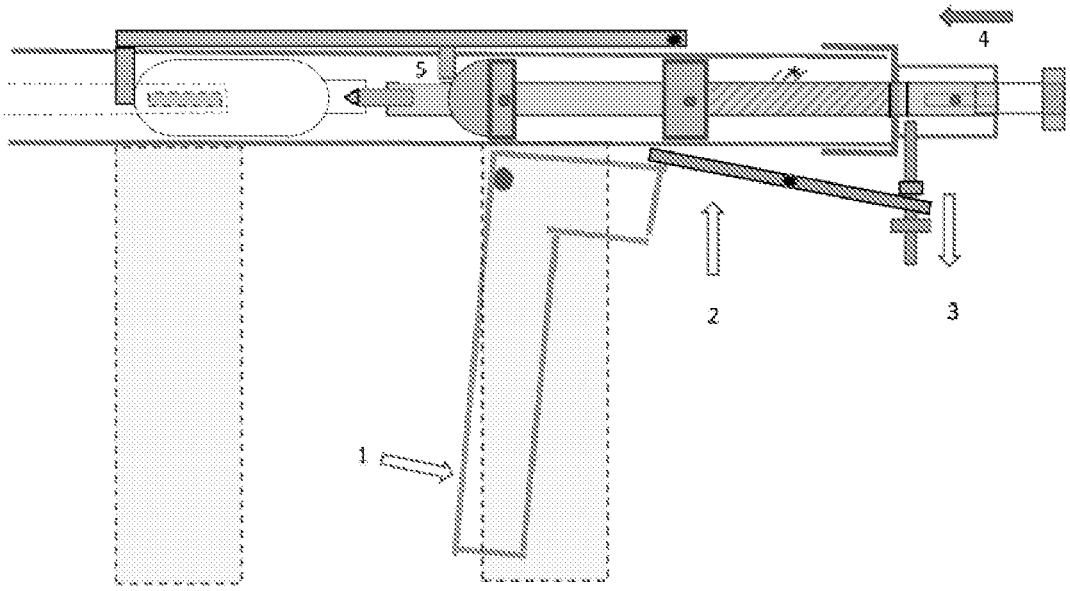
FIG. 4B is a mechanistic view of action of the device.
Figure 4C:
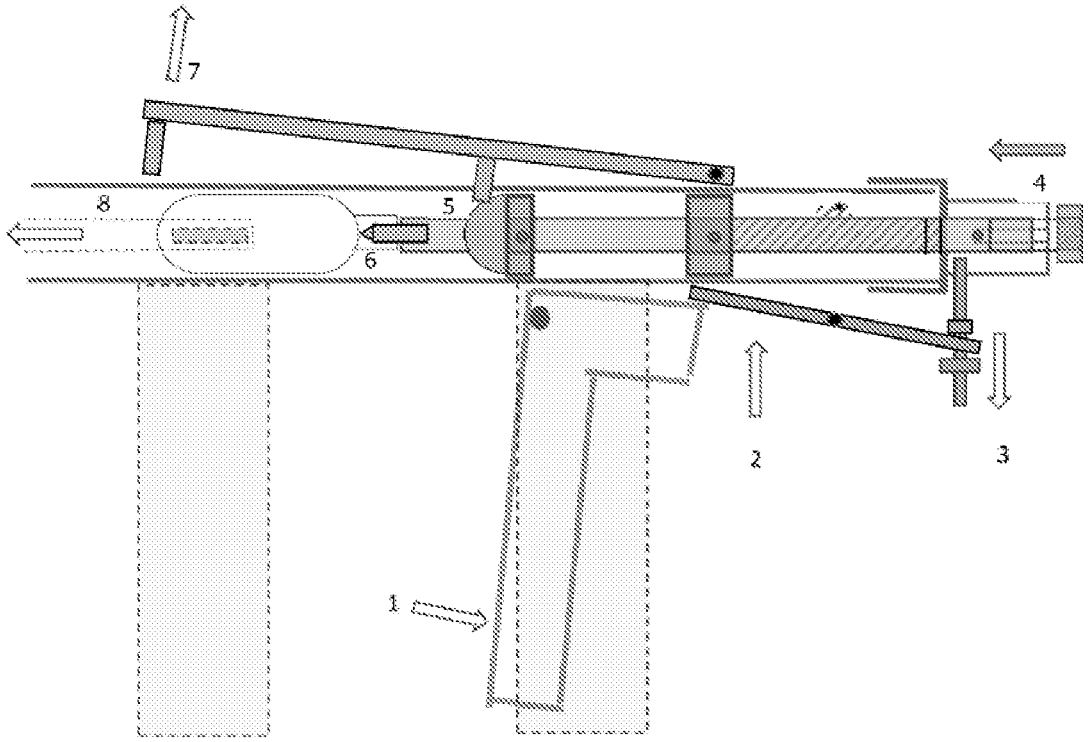
FIG. 4C is a mechanistic view of action of the device.

A mechanism of operating the device 10 is illustrated in FIGS. 4A-C. Starting with the device 10 in the loaded and armed condition as shown in FIG. 1A. To utilize the device, the user first removes the safety pin from the rear handle. This step would also activate the laser used for aiming (if present). The user then aims the device 10 holding one handle 101 in each hand near bottom ends of the twin handles 101. Alternatively, the user could rest the twin handles 101 on a desk or counter, to help steady the device 10. The user then squeezes the trigger 109, moving it towards or into the rear handle 101. The device 10 then releases the rocket projectile 20.

The trigger 109 is pressed, moving it to a position near to or within the rear handle 101. A first end of the trigger lever 108 is lifted by contact with the back portion of the trigger 109. A second end of the trigger lever 108 interfaces with the retaining pin 113. When the first end of the trigger lever 108 is lifted, the second end of the trigger lever 108 enables the retaining pin 113 to be pulled downwards out of the shaft 11 of the puncture member 106, releasing the puncture member 106. The motion of the shaft and puncture member is shown in FIG. 4B.

The puncture member 106 moves forward and begins to puncture a rear membrane of the cartridge 202. The rounded cam 112 of the shaft 11 acts on the release rod pin 113, to lift the release rod 107. Further motion of the puncture member 106 through the membrane of the cartridge 202 lifts the release rod 107 with the steel pin 113 and the vertical bar 1072, which then releases the cartridge 202 as shown in FIG. 4C.

The puncture member 106 moves fully through the membrane of cartridge 202. The cam 112 elevates the pin 1071 further which lifts the release rod 107 with the release bar 1072 upwards, allowing the cartridge 202 to move forward in the barrel 104. The launch is complete.

Figure 5:
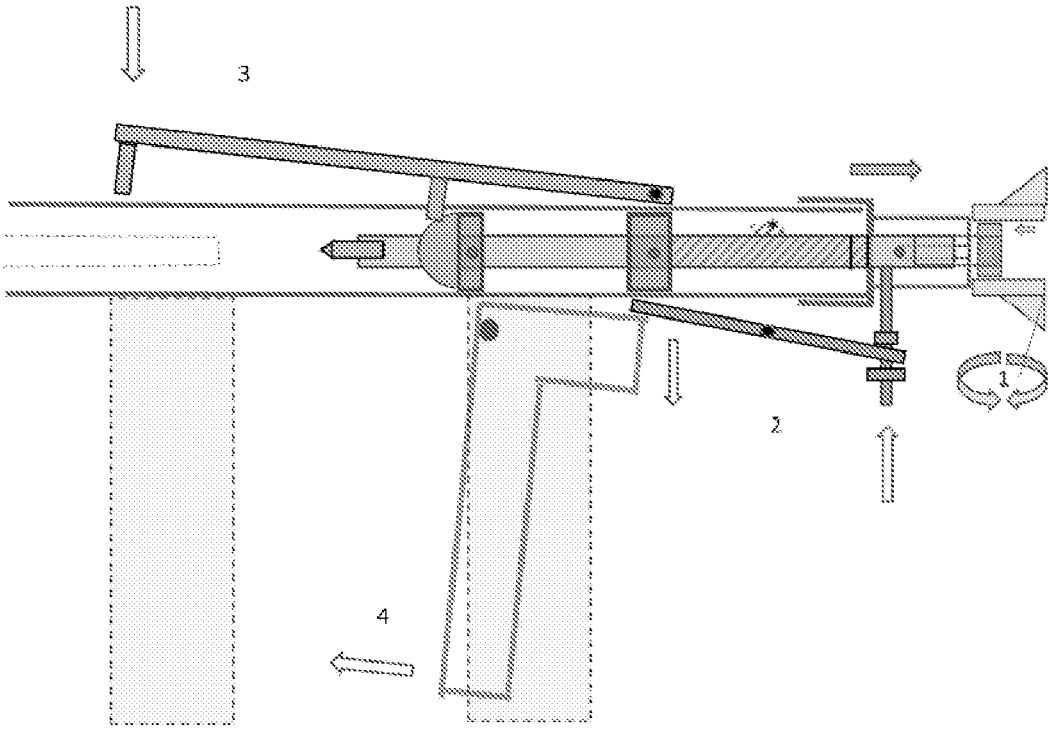
FIG. 5 is a final mechanistic view of action of the device.

FIG. 3 is a drawing from a photograph of the device 10 construed as an exemplary embodiment of the present disclosure, after insertion of a rocket projectile with 12" tail. The cartridge is inside the barrel of the device but is attached to the tail spars outside the launcher. The device when loaded weigh 750 grams (1.65 pounds). The steps of arming and loading the launcher for the next launch are shown in FIG. 5. A socket wrench is placed on the nut on the rear end of the puncture device shaft and rotated with a small electric drill or by hand, causing it to advance over threads towards the front and pulling the shaft towards the rear (step 1). This retracts the shaft until the steel pin automatically inserts into and through the hole in the shaft, due to spring action on the trigger lever (step 2). The release lever rotates downward and the release shaft re-enters the barrel due to spring action (step 3). The trigger automatically reverts to its initial position due to spring action (step 3). The rotation of the nut is then reversed, and the nut moves rearward again automatically stops at the tip of the shaft (step 1). The rocket cartridge is then loaded into the barrel with the fins outside, while holding the release lever up with fingers. The configuration then returns to appearance of FIG. 1A.

Tests.

To test the device, a launching stand was created with a long vice which held the tips of both handles onto a lightweight workbench. Each of the lower ends of the handles were inserted one inch into the vice. A target was created from construction foam sheets ¾" to 2" thick, 4 feet wide and 8 feet tall. The total thickness was 7". The target was placed 20 feet from the target. The bullseye was at approximately the same height as the device at both distances. A point laser light was fastened to the tip of one of the aluminum channels on the outside of the barrel. The stand and vice were adjusted so the laser and rocket were directed towards the bullseye. The rocket was fired by squeezing the trigger of the device. In one of the tests the device was completely hand-held and aimed during launch. Five rockets were fired having 18" long spars for the tail fins. Another five rockets had 10-12" spars, to see whether the change in length of the tail sections had any effect on accuracy and impact force of the rockets.

We also performed similar tests with a target at 10 feet from the tip of the device, using five rockets with 10" spars and three tailfins. These rockets were fired from the launcher described above, but before the trigger mechanism was completed and installed. In these tests, the steel pin was pulled directly from the hole in the puncture device, using pliers to hold and withdraw the steel pin. For a video of the hand-launched Rocket Dart test see:

https://www.dropbox.com/s/1ncl1z0hbdz0c4x/20210814%2018%20inch%20hand.mp4?dl=0.

Results of Testing.

Figure 6:
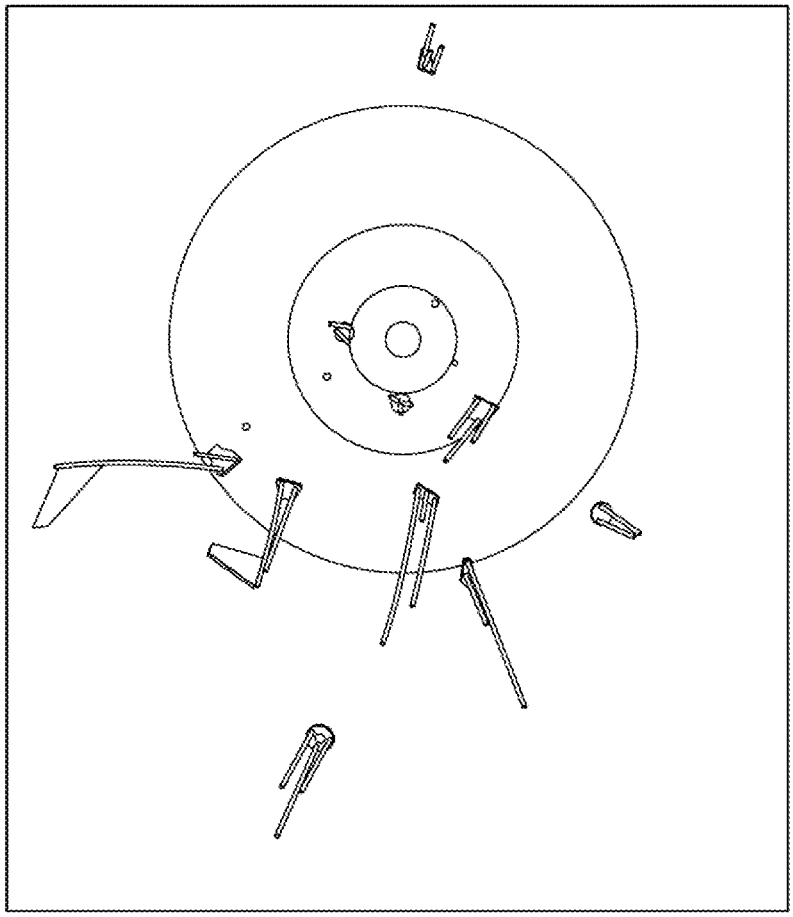
FIG. 6 is a photograph of a target after 10 rocket projectiles were fired at the target 20 feet from the device.

FIG. 6 is a photograph of the target after 10 rocket projectiles were fired at the target 20 feet from the device. Circles drawn are 3", 6" and 12" from center of bullseye. All rockets hit the target in less than 0.2 seconds, giving a calculated average velocity of over 70 miles per hour. From video analysis of the launchings, none of the rockets had any structural failures during launch or flight. The $CO_2$ cartridges of all rockets penetrated more than one layer of the 2" thick construction foam and stuck in the cavity they created (the one empty hole is from a rocket which went completely through the first two layers of foam). The average distance of impact from bullseye was 10+/−7 inches for the rockets with 10-12" tails and 11+/−3 inches for the rockets with 18" tails (no significant difference). The rockets with 10-12" tails made a deeper crater in the construction foam than those with 18" tails, indicating higher velocity. The rockets with 10-12" tails embedded the entire $CO_2$ cartridge and the attachments to the spars into the construction foam (a distance of about 3"). The rockets with 18" tails embedded about ⅔ of the $CO_2$ cartridge into the foam. For all rockets, some or all the spars fractured at time of impact (they were constructed from ⅛"×⅛" basswood). FIG. 6 shows the accuracy and penetration of the rocket projectile at 20-foot distant target. Circles are drawn at 3, 6, and 12 inches from center of bullseye.

Figure 7:
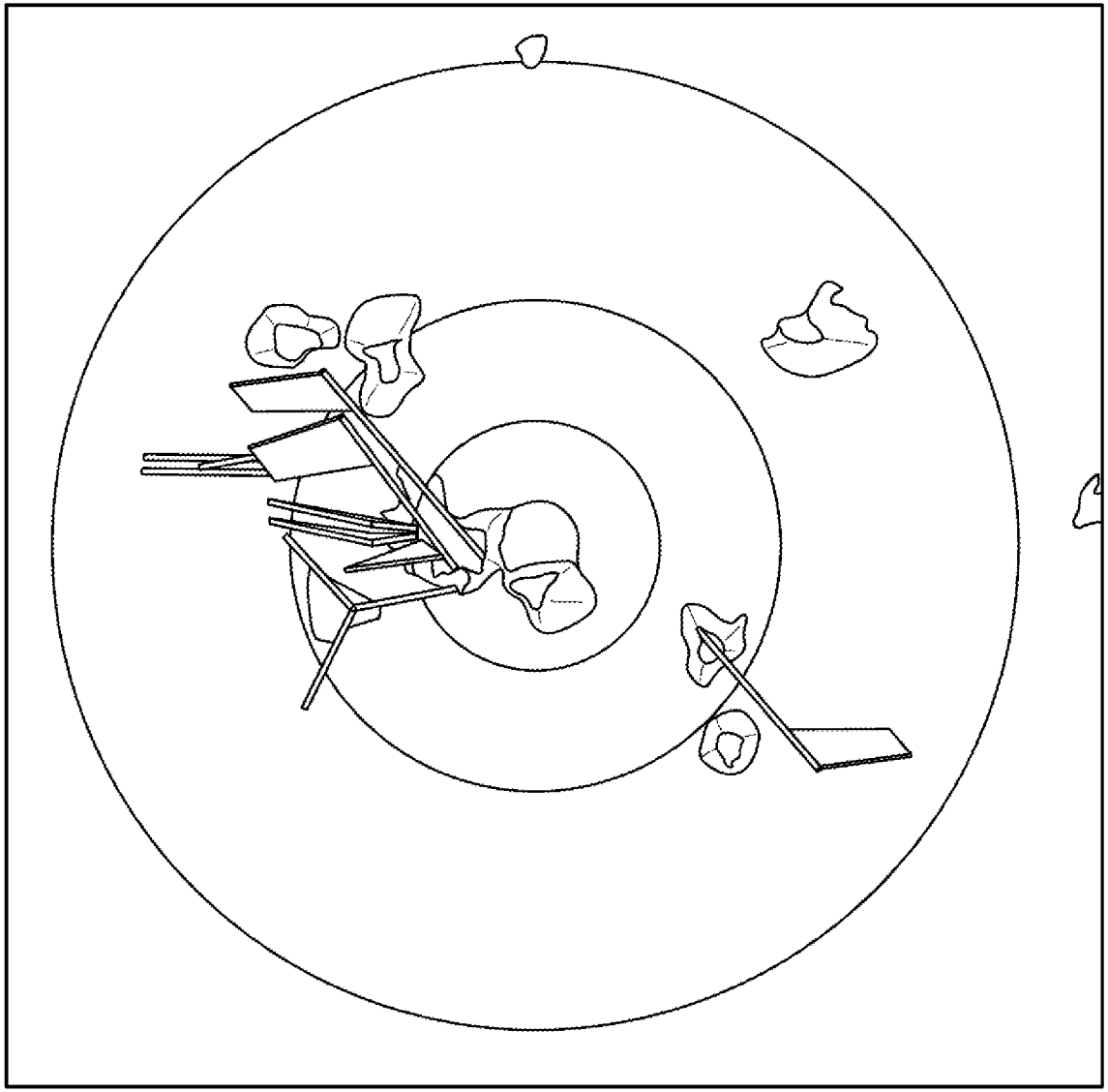
FIG. 7 shows the accuracy and penetration of five rocket projectiles at 10-foot distance from the device.

FIG. 7 shows the accuracy and penetration of five rocket projectiles at 10-foot distant target. Circles are drawn at 3, 6, and 12 inches from center of bullseye. All rockets had 10-12-inch tails and all hit within 6" of the centers of the bullseye. Holes without rockets are from previous tests with a different launching device. FIG. 7 is a photograph of the target after five Rocket Darts were fired at the target 10 feet from the launcher. Circles drawn are 3", 6" and 12" from center of bullseye. These rockets all had tails of 10" length. The rockets hit the target in less than 0.1 seconds, giving a calculated average velocity of over 70 miles per hour. From video analysis of the launchings, none of the rockets had any structural failures during launch or flight. The cartridges of these rockets all penetrated completely through the second layer of the thick construction foam and stuck in the cavity they created. The average distance of impact from bullseye was 4+/−2 inches for these rockets with 10" tails. The closer range of the target at 10 feet distance obviously produced higher accuracy of the rocket projectile versus the target at 20 feet. Impact force also appeared to be greater at the shorter distance from the target (10 feet vs. 20 feet) as judged by the depth of cavities produced.

In summary, the accuracy tests of the device show acceptable accuracy for personal protection purposes if the target is at 10-foot distance or less. The impact is with considerable force since construction foam is made of durable material. By hand, when 40 lbs of force are applied to a cartridge, the rounded front surface will make a dent in the foam only about ½" deep. Therefore, the rocket impact must have exerted many times this force. The $CO_2$ cartridges of the device and the attachments to the tail spars made cavities of more than 3", routinely in the construction Styrofoam. These tests were done without a needle being attached to the front of the device. However previous tests have shown that the needle (or even a nail) attached to the front of the rocket made no difference in the accuracy of the device or force of impact.

From the tests done so far, it appears that the device would be a very effective weapon for personal defense, at a range of 10 feet and could be used at a range of 20 feet. As seen from the cavities made by the rockets when impacting construction foam, the impact imparts considerable force on the target. This force of impact alone would cause pain and unbalance an assailant, as well as soft tissue and/or bone damage. Injury would be made more intense by adding a sharp point to the device. The types of injury imparted by the device might be serious but should not be fatal. Of course, a defensive weapon of this type would be utilized only when an individual is faced with clear aggression by an assailant armed with weapons which could inflict serious injury or death to that individual or others.

On a lighter note, the device should be attractive to those who enjoy the sport of shooting guns, bows and arrows, crossbows, etc. Part of this enjoyment comes from the skill required to aim the weapons accurately and hit targets at various ranges. Another part comes from the surprisingly fast projectiles which come from these weapons, and the elegant physical principles which result in this velocity. Some of the fun of shooting of course also comes from the ability to impart significant damage to distant inanimate objects (watermelons and pumpkins seem to be favorite targets). The device could be a favorite of shooting enthusiasts, since the physical principles are complex, and the ability to fire a rocket horizontally to hit a target is unusual, certainly for rockets not using any kind of combustion and or intense heat in the exhaust. With rockets powered by $CO_2$, the cartridges are very cold to the touch after the launch.

The device fulfills all the requirements listed above for a safe and effective weapon for self-defense or for sporting fun. The device can be safely stored in loaded and armed condition without risk of accidental launch since the release mechanism is highly secure (a steel pin through the brass shaft of the puncture device). The device cannot be fired without the mechanical advantage of the trigger mechanism, and the trigger itself is blocked by a safety pin. Because of its highly secure release mechanism, the device can be stored while cocked, and used immediately by bringing it out of a drawer and removing the safety pin.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A weapon for self-defense of a user against a target, the weapon comprising:

a barrel having a front end and a posterior end, the barrel comprises at least two slots; a trigger; a puncture member; and at least one projectile, the projectile having a gas cylinder located at a front end of the projectile and at least two fins located at a posterior end of the projectile;

wherein the projectile is loaded within the barrel with the gas cylinder located at the front end of the barrel, the at least two fins located outside the posterior end of the barrel, and the puncture member located between the gas cylinder and the at least two fins;

wherein the trigger is configured to release the puncture member and to direct the puncture member to puncture the gas cylinder, enabling the projectile to be released from the front end of the barrel as the puncture is completed.

2. A weapon as in claim 1, wherein the projectile is rocket shaped.

3. A weapon as in claim 1, wherein the gas cylinder is a $CO_2$ cylinder.

4. A weapon as in claim 1, wherein the trigger is configured to release the puncture member via a spring.

5. A weapon as in claim 1, further comprising:

a release bar located in front of the gas cylinder to hold the gas cylinder in position while the puncture member penetrates the membrane on the back of the cartridge, the motion of the puncture member also moves the release bar outwards to allow the gas cylinder to accelerate;

a release pin configured to traverse a shaft of the puncture member, to prevent the puncture member to be released and to keep the weapon in an loaded and armed position securely; and a trigger lever, having a first end and a second end;

wherein the first end of the trigger lever is configured to be lifted by contact with the back portion of the trigger and the second end of the trigger lever is configured to enable the steel pin to be pulled out of the shaft of the puncture member, releasing the puncture member.

6. A weapon as in claim 5, wherein the trigger is configured to enable the steel pin to be pulled out of the shaft of the puncture member via a spring.

7. A weapon as in claim 5, further comprising a barrel for holding the cartridge and assuring proper direction to assure accuracy of flight;

the barrel having slots on a forward end which allow the cartridge inside the barrel to attach to tail struts and fins on the outside of the barrel, and all advance together, also allowing for use of a longer and wider tail than could fit within a barrel, and wherein the slots also allow gas to escape as the cartridge accelerates down the barrel, avoiding a "gun" effect from pressurized gas in the barrel, since gases exiting with the rocket would affect the course of the rocket cartridge as it leaves the barrel.

* * * * *